US006863349B2

(12) United States Patent
Belic

(10) Patent No.: US 6,863,349 B2
(45) Date of Patent: Mar. 8, 2005

(54) METAL FRAME FOR CHAIRS WITH TUBULAR ELEMENTS

(75) Inventor: Edi Belic, Koper (SI)

(73) Assignee: Cerantola S.r.l., Ramon di Loria (IT)

( * ) Notice: Subject to any disclaimer, the term of this patent is extended or adjusted under 35 U.S.C. 154(b) by 91 days.

(21) Appl. No.: 10/220,797

(22) PCT Filed: Dec. 28, 2001

(86) PCT No.: PCT/EP01/15374

§ 371 (c)(1),
(2), (4) Date: Sep. 5, 2002

(87) PCT Pub. No.: WO02/054913

PCT Pub. Date: Jul. 18, 2002

(65) Prior Publication Data

US 2003/0090140 A1 May 15, 2003

(30) Foreign Application Priority Data

Jan. 9, 2001 (IT) ..... PD01U0001

(51) Int. Cl.[7] ..... A47C 7/02

(52) U.S. Cl. ..... 297/452.19; 297/448.1; 297/449.1

(58) Field of Search ..... 297/452.18, 452.19, 297/452.2, 445.1, 449.1, 451.1, 448.1, 440.22

(56) References Cited

U.S. PATENT DOCUMENTS 2,981,319 A * 4/1961 Close
3,057,661 A * 10/1962 Moxley
3,159,428 A * 12/1964 Schier
4,097,089 A * 6/1978 Petersen
4,400,031 A * 8/1983 DeDecker
5,224,760 A * 7/1993 Gibbs
6,174,029 B1 * 1/2001 Swy
6,523,904 B1 * 2/2003 Vanderminden

FOREIGN PATENT DOCUMENTS

| | | |
|---|---|---|
| DE | A-196 45 671 | 5/1998 |
| FR | A-1 020 112 | 2/1953 |
| FR | A-2 623 701 | 6/1989 |

* cited by examiner

*Primary Examiner*—Peter M. Cuomo
*Assistant Examiner*—Stephen Vu
(74) *Attorney, Agent, or Firm*—Wood, Phillips, Katz, Clark & Mortimer

(57) ABSTRACT

A metal frame for chairs with tubular elements, comprising two inverted U-shaped elements (10), which form the legs, two L-shaped elements (11), which form the support for the seat and the back and are each arranged next to one of the preceding elements, and two rod-like cross-members (12), which are arranged in a lower region so as to join portions of the inverted U-shaped elements and of the L-shaped elements. The cross-members (12) are joined to the other elements by projection welding at a pair of protrusions (13) determined by corresponding recesses (14) in the cross-section, formed by a flattening plastic deformation.

4 Claims, 3 Drawing Sheets

METAL FRAME FOR CHAIRS WITH TUBULAR ELEMENTS

BACKGROUND OF THE INVENTION

The present invention relates to a metal frame for chairs with tubular elements.

Metal frames for chairs with tubular elements are already known which comprise two elements shaped like an inverted U, which form the legs, two L-shaped elements, which form the support for the seat and the back and are each arranged next to one of the preceding elements, and two rod-like cross-members, which are arranged in a lower region so as to join portions of the inverted U-shaped elements and of the L-shaped elements.

These elements are currently assembled and joined one another by resting the cross-members against the inverted U-shaped elements and the L-shaped elements, whose cross-section is normally substantially ellipsoidal, and by then performing gas welding with deposition of weld material, for example electric continuous-wire welding.

The problem currently found in this type of structure is indeed caused by the type of welding, which requires long execution times and the consumption of material related to the wire and to the gas.

This, in terms of cost containment, is currently an important aspect, since chairs using the above described structure are rather widespread commercially and are manufactured by several companies, and therefore their costs are highly influenced by the presence of competition.

SUMMARY OF THE INVENTION

The aim of the present invention is to provide a metal frame for chairs with metal tubular elements that eliminates the drawback noted above in known types.

Within this aim, a consequent primary object is to shorten production times and reduce the associated costs.

Another object is to provide a frame that is at least as solid as that of currently commercially available frames.

Another object is to provide a frame that can be manufactured with per se known technologies.

This aim and these and other objects that will become better apparent hereinafter are achieved by a metal frame for chairs with tubular elements, of the type comprising two inverted U-shaped elements, which form the legs, two L-shaped elements, which form the support for the seat and the back and are each arranged next to one of the preceding elements, two rod-like cross-members, which are arranged in a lower region so as to join portions of the inverted U-shaped elements and of the L-shaped elements, characterized in that said cross-members are joined to the other elements by projection welding at pairs of protrusions determined by corresponding recesses in the cross-section, obtained by means of a flattening plastic deformation.

BRIEF DESCRIPTION OF THE DRAWINGS

Further characteristics and advantages of the invention will become better apparent from the following detailed description of an embodiment thereof, illustrated only by way of non-limitative example in the accompanying drawings, wherein.

DESCRIPTION OF THE PREFERRED EMBODIMENTS

Figure 1:
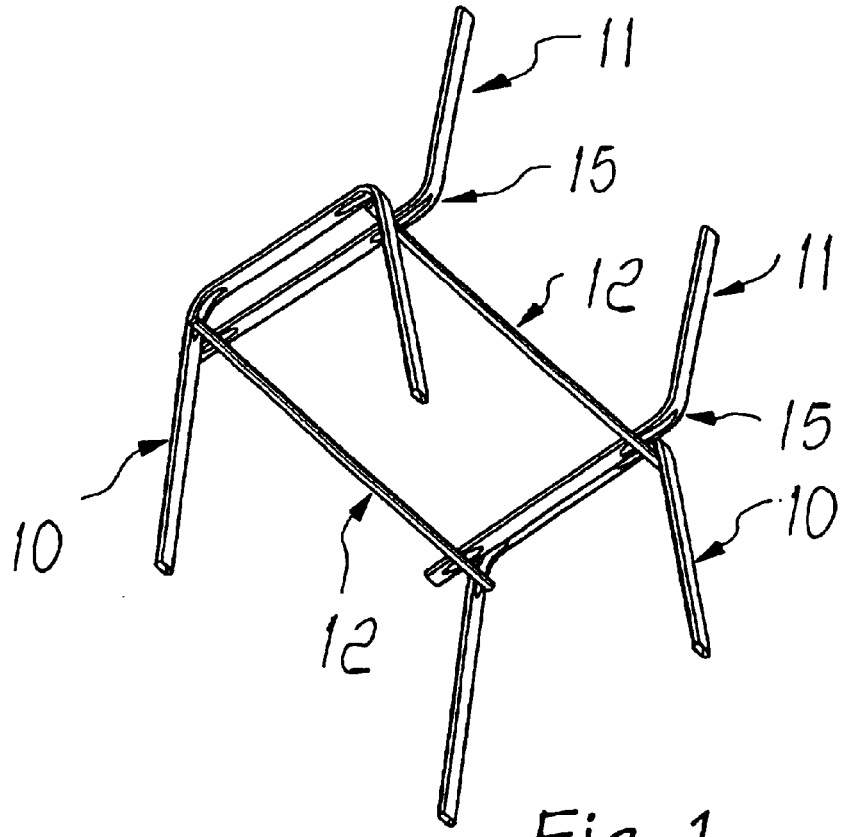
FIG. 1 is a bottom perspective view of a frame having the structure according to the invention.
Figure 2:
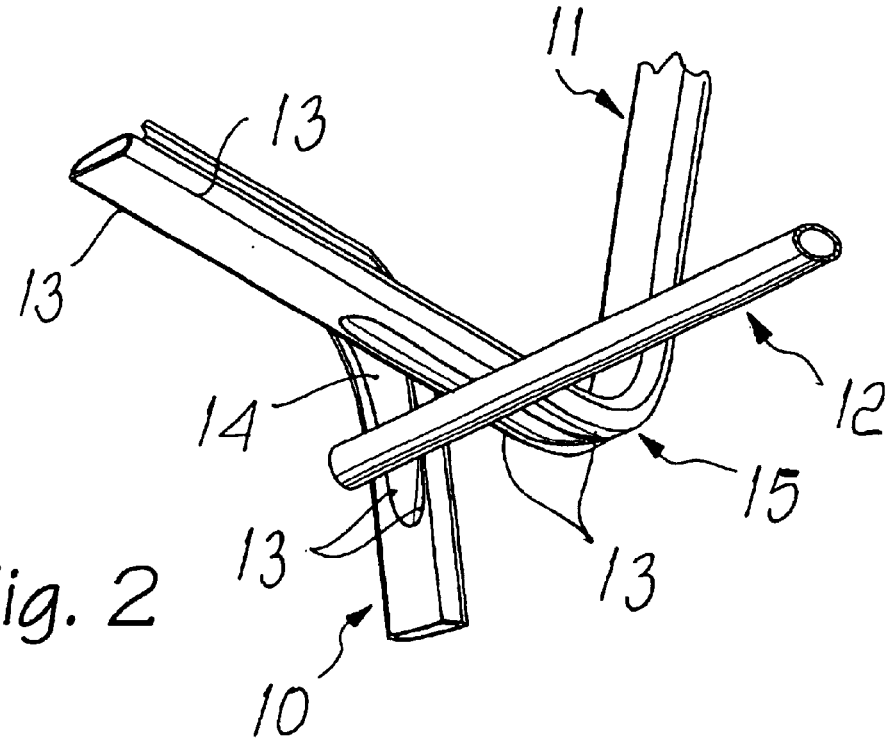
FIG. 2 is an enlarged-scale perspective view of a detail of the frame of FIG. 1.
Figure 3:
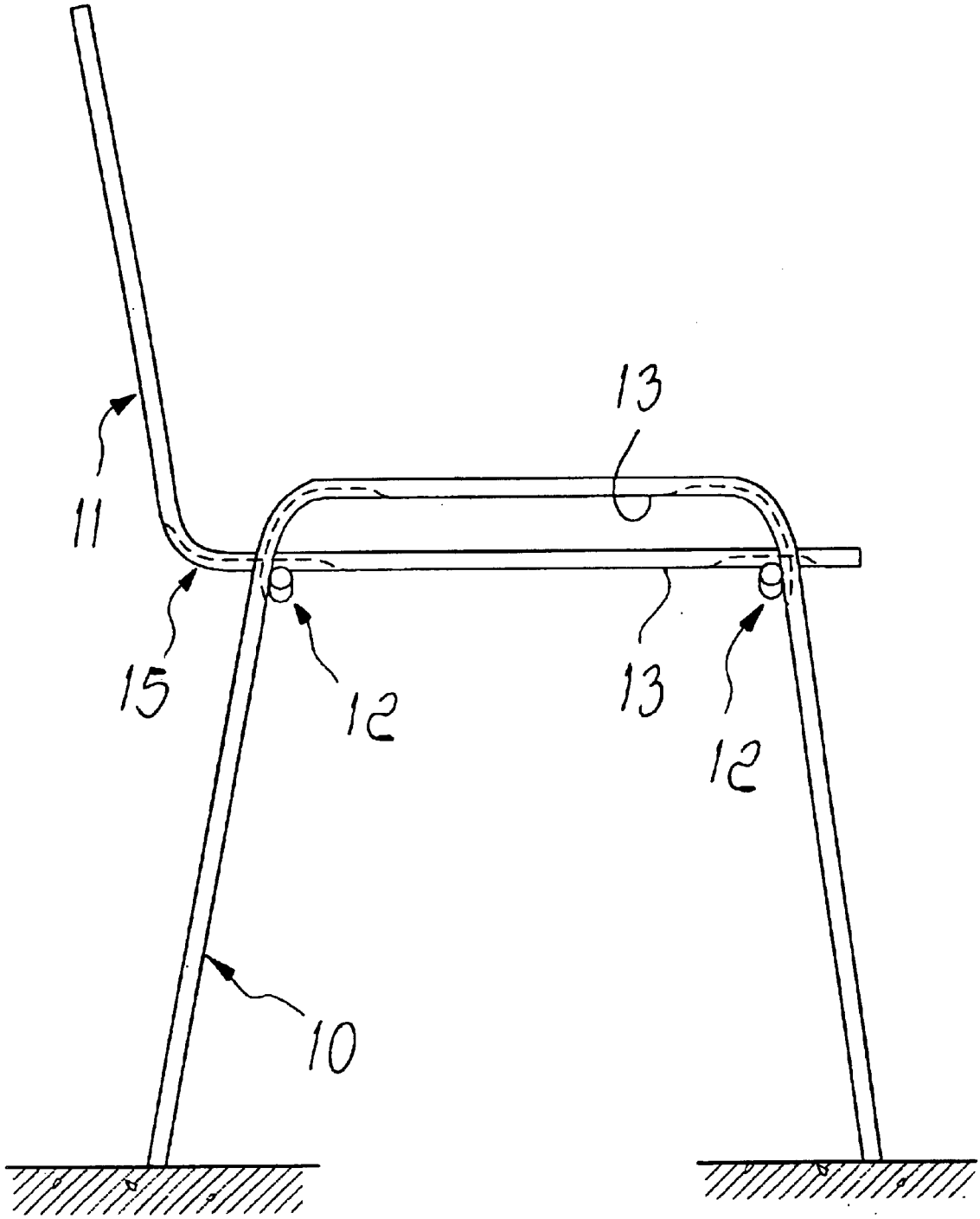
FIG. 3 is an enlarged-scale side view of the frame of FIG. 1.
Figure 4:
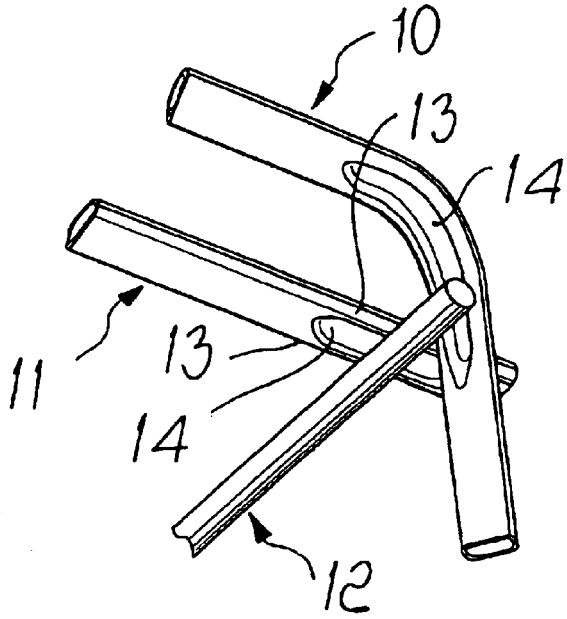
FIG. 4 is another enlarged-scale perspective view of a detail of the frame of FIG. 1.
Figure 5:
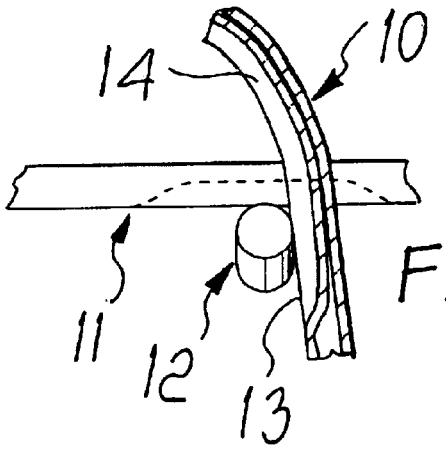
FIG. 5 is a sectional view of the detail of FIG. 4.
Figure 6:
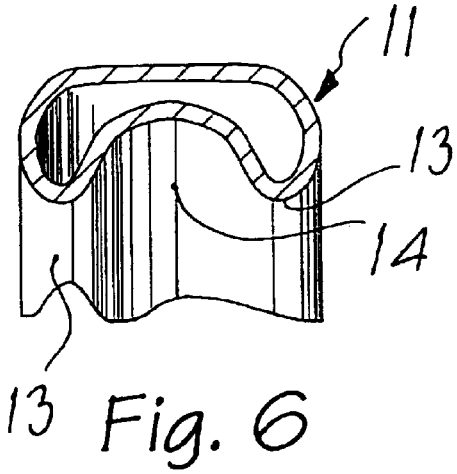
FIG. 6 is a perspective sectional view of a portion of the frame deformed by flattening.
Figure 7:
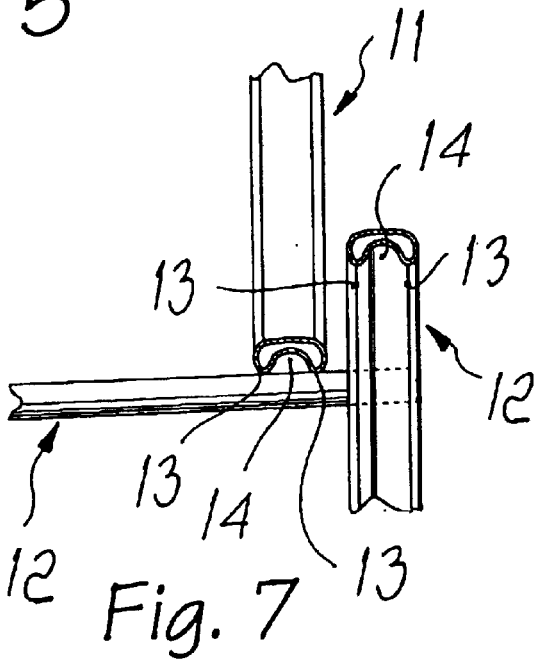
FIG. 7 is a view of another detail of FIG. 4.

With reference to the figures, a metal frame for a chair with tubular elements comprises two inverted U-shaped elements 10, which form the legs, two L-shaped elements 11, which form the resting support for the seat and the back, not shown in the figures for the sake of simplicity, each arranged next to one of the preceding elements 10, and two rod-like cross-members 12 arranged in a lower region so as to join the inverted U-shaped elements 10 and the L-shaped elements 11.

The elements 10 and 11 are made of metal tube, with a cross-section that is substantially elliptical but can also be oval, while the cross-members 12 are straight and have a circular cross-section.

According to the invention, the cross-members 12 are joined to the inverted U-shaped elements 10 and to the L-shaped elements 11 by projection welding at pairs of protrusions 13 formed by corresponding recesses 14 in the cross-section, produced by a flattening plastic deformation.

In practice, as regards the inverted U-shaped elements 10, welding is performed proximate to the bending regions, extending the recesses that are provided in the regions that are not visible in order to form the bend, which as is known would otherwise produce wrinkle due to the excess of material in the regions having a smaller radius.

As regards the L-shaped elements 11, instead, at the front the flattening must be provided expressly, since a region not adjacent to bends is to be welded, while at the rear the flattened portion of the bend 15 is used (an extension of the flattened portion of the rear bend up to the front region can also be provided).

From the point of view of manufacture, it is simply necessary to provide an extension of the punches that produce the flattened region for the bend 15 and to provide new punches for the front regions of the L-shaped elements 11.

In the end a frame is obtained in which welding is performed without depositing material, simply and rapidly, since the welding spots are determined directly by means of the plastic deformation operation, which is required, both for the elements 10 and for the elements 11, due to the need to bend the components.

Furthermore, projection welding is a quick operation, which is performed simultaneously for a plurality of regions, without having to proceed in succession, portion by portion, as currently entailed by wire welding.

In practice it has been observed that the intended aim and objects of the present invention have been achieved.

In practice, the materials employed, so long as they are compatible with the contingent use, as well as the dimensions, may be any according to requirements.

The disclosures in Italian Utility Model Application No. PD2001U000001 from which this application claims priority are incorporated herein by reference.

What is claimed is:

1. A metal frame for chairs with tubular elements, said frame comprising two inverted U-shaped elements, defining two pairs of legs, two L-shaped elements, defining a support for a seat and a back wherein each of the elements is arranged next to one of the preceding elements, two rod cross-members, which are arranged in a lower region so as to join the inverted U-shaped elements and the L-shaped elements, wherein said cross-members are joined to said U-shaped elements and said L-shaped elements by projection welding at a pair of protrusions determined by corresponding recesses in the cross-section, formed by a flattening plastic deformation, said pair of protrusions being formed at outside edges of said recesses, said cross-members being arranged transversely to said U-shaped elements and said L-shaped elements such that said cross-members are arranged also transversely to said recesses and said cross-members rest on said pair of protrusions outside of said recesses, said cross-members being welded to said U-shaped elements and said L-shaped elements at said pair of protrusions upon which said cross-members rest outside of said recesses.

2. The frame according to claim 1, wherein said inverted U-shaped elements and said L-shaped elements are made of metal tube having one of a substantially oval and elliptical cross-sections, while said cross-members are straight and have a circular cross-section.

3. The frame according to claim 1, wherein the welding of each of said inverted U-shaped elements is performed proximate to each of its respective bend, by extending the recesses that are provided in regions not in view in order to produce the bend.

4. The frame according to claim 1, wherein each of said L-shaped elements having a flattened portion which is at the front in a region that is not adjacent to a bend and is provided at the rear proximate to the bends, by extending the recesses to produce the bend.

* * * * *